US007019600B2

(12) United States Patent
Shono

(10) Patent No.: US 7,019,600 B2
(45) Date of Patent: Mar. 28, 2006

(54) WAVEGUIDE/PLANAR LINE CONVERTER AND HIGH FREQUENCY CIRCUIT ARRANGEMENT

(75) Inventor: Masayoshi Shono, Kobe (JP)

(73) Assignee: Fujitsu Ten Limited, Hyogo (JP)

( * ) Notice: Subject to any disclaimer, the term of this patent is extended or adjusted under 35 U.S.C. 154(b) by 74 days.

(21) Appl. No.: 10/651,102

(22) Filed: Aug. 29, 2003

(65) Prior Publication Data

US 2004/0041651 A1 Mar. 4, 2004

(30) Foreign Application Priority Data

Aug. 29, 2002 (JP) ..... 2002-251508

(51) Int. Cl.
*H01P 5/107* (2006.01)

(52) U.S. Cl. ..... 333/26; 333/33; 333/247

(58) Field of Classification Search ..... 333/26, 333/33, 247, 248
See application file for complete search history.

(56) References Cited

U.S. PATENT DOCUMENTS 5,770,981 A * 6/1998 Koizumi et al. ..... 333/26
5,982,250 A * 11/1999 Hung et al. ..... 333/26
6,040,739 A * 3/2000 Wedeen et al. ..... 330/66
6,060,959 A * 5/2000 Yakuwa ..... 333/26
6,239,669 B1 * 5/2001 Koriyama et al. ..... 333/26
6,356,173 B1 * 3/2002 Nagata et al. ..... 333/247

FOREIGN PATENT DOCUMENTS

| | | |
|---|---|---|
| JP | 06-112708 | 4/1994 |
| JP | 08-139504 | 5/1996 |
| JP | 11-150403 | 6/1999 |

* cited by examiner

*Primary Examiner*—Benny Lee
(74) *Attorney, Agent, or Firm*—Wenderoth, Lind & Ponack, L.L.P.

(57) ABSTRACT

A waveguide/planar line converter is provided which enables a simplified assembling operation and accurate positioning of a signal line. The waveguide/planar line converter includes a housing having a waveguide and a waveguide/planar line conversion substrate with a signal line propagating high frequency signals formed on one main surface side and a ground formed on the other main surface side, wherein one end portion of the signal line of the waveguide/planar line conversion substrate is located in such a manner so as to protrude into the waveguide, and the waveguide/planar line conversion substrate is arranged on the whole top surface of the housing so as to cover the mouth of the waveguide.

4 Claims, 10 Drawing Sheets

Fig.11 (a) PRIOR ART

Fig.11 (b) PRIOR ART

WAVEGUIDE/PLANAR LINE CONVERTER AND HIGH FREQUENCY CIRCUIT ARRANGEMENT

BACKGROUND OF THE INVENTION

1. Field of the Invention

The present invention relates to a waveguide/planar line converter and a high frequency circuit arrangement and, more particularly, to a waveguide/planar line converter whereby the transmission mode of a high frequency signal such as a microwave or a millimeter wave can be converted, and a high frequency circuit arrangement.

2. Description of the Relevant Art

In sending-receiving sections of radar sensors of various kinds, such as a mobile radar system, a waveguide/planar line converter has been used for outputting a high frequency signal sent from a high frequency circuit to an antenna with a conversion from the planar line mode to the waveguide mode, or inputting a high frequency signal received through the antenna to the high frequency circuit with a conversion from the waveguide mode to the planar line mode.

FIG. 10 is a perspective view partly in section schematically showing a conventional waveguide/planar line converter. FIGS. 11(*a*) and 11(*b*) are schematic diagrams showing a waveguide/planar line conversion substrate, wherein FIG. 11(*a*) is a top view thereof, while FIG. 11(*b*) is a bottom view thereof.

Reference numeral 50 in FIG. 10 represents a metallic housing. At a prescribed location on the housing 50, a waveguide 50*a* comprising a through hole is formed. Over the mouth of the waveguide 50*a*, a metallic short-circuiting lid 51 is arranged. The distance between the top surface of a protrusion portion of a waveguide/planar line conversion substrate 52 and the inner surface of the short-circuiting lid 51 opposed to the above-mentioned top surface is set to be about $\lambda/4$ (where $\lambda$ is a wavelength of a millimeter wave or the like within the waveguide) so that the inner surface of the short-circuiting lid 51 becomes a short-circuiting plane.

As shown in FIG. 10, on the top surface of the housing 50, the waveguide/planar line conversion substrate 52 is arranged in such a manner that one end portion thereof protrudes into the waveguide 50*a*. As shown in FIGS. 11(*a*) and 11(*b*), on the top surface of a dielectric substrate 52*a* constituting the main body of the waveguide/planar line conversion substrate 52, a signal line 52*b* propagating high frequency signals and a patch portion 52*c* located above the mouth of the waveguide 50*a* are formed, as shown in FIG. 11(*a*), while on the bottom surface thereof except the portion thereof protruding into the waveguide 50*a*, a ground 52*d* is formed, as shown in FIG. 11(*b*). The waveguide/planar line conversion substrate 52 comprises the dielectric substrate 52*a*, signal line 52*b*, patch portion 52*c* and ground 52*d*.

As shown in FIG. 10, in the vicinity of the other end portion of the waveguide/planar line conversion substrate 52 on the top of the housing 50, high frequency ICs 53 are mounted, which are electrically connected to the signal line 52*b*. Around the high frequency ICs 53 on the top of the housing 50, an interconnection substrate 54 in which circuits of various kinds or interconnections are formed is mounted.

On the other hand, as shown in FIG. 10, on the bottom surface of the housing 50, a plane antenna 55 is arranged for receiving a high frequency signal from an outside source to output it to the waveguide 50*a* or for emitting externally a high frequency signal transmitted through the waveguide 50*a*.

In such a waveguide/planar line converter, a high frequency signal (such as a microwave or a millimeter wave) received through the plane antenna 55 propagates within the waveguide 50*a*, reaches the inner surface of the short-circuiting lid 51 so as to make a short circuit. Consequently, the high-frequency electric field peaks in the vicinity of the patch portion 52*c* of the waveguide/planar line conversion substrate 52. Therefore, in the waveguide/planar line conversion substrate 52, as shown in FIGS. 10, 11(*a*) and 11(*b*), the high frequency signal is efficiently converted from the waveguide mode to the planar line mode, and the high frequency signal converted into the planar line mode propagates through the signal line 52*b* to be transmitted to the high frequency ICs 53.

On the other hand, a high frequency signal output from the high frequency ICs 53 propagates in the planar line mode through the signal line 52*b* of the waveguide/planar line conversion substrate 52, and with a conversion from the planar line mode to the waveguide mode in the patch portion 52*c*, it is emitted into the waveguide 50*a* to be transmitted to the plane antenna 55.

However, in the conventional waveguide/planar line converter, since the opening size of the waveguide 50*a* becomes much smaller (e.g. about 2.54 mm×1.27 mm for a millimeter wave of 76 GHz), the waveguide/planar line conversion substrate 52 which is arranged with a protrusion into the waveguide 50*a* needs to be processed in accordance with the size of the small opening. Therefore, the size of the substrate cannot be made larger, resulting in complicated substrate processing. Moreover, it is becoming more difficult to accurately fit together the mouth of the waveguide 50*a* and the patch portion 52*c* of the waveguide/planar line conversion substrate 52. Therefore, if a displacement or the like is caused, the matching characteristic is degraded, so that it becomes impossible to obtain a high conversion efficiency.

The waveguide/planar line conversion substrate 52 is required to be a double-sided substrate in order to form a microstrip line thereon, so that it is constituted as a single component. Therefore, the sharing thereof with another component such as the interconnection substrate 54 has not been achieved. As a result, the circuit area formed on the top of the housing 50 becomes large, thus preventing a significant downsizing of the device.

In the conventional waveguide/planar line converter, the metallic housing 50 is used as a platform, resulting in a high cost and a difficulty in weight reduction.

SUMMARY OF THE INVENTION

The present invention was developed in order to solve the above problems, and it is an object of the present invention to provide a waveguide/planar line converter, which enables a simplified assembling operation and accurate positioning of a signal line.

It is another object of the present invention to provide a high frequency circuit arrangement, which enables a reduction in cost due to a reduced component count, and reductions in weight and size of the device as well.

In order to achieve the above objects, a waveguide/planar line converter according to the first aspect of the present invention is characterized by comprising a housing having a waveguide and a waveguide/planar line conversion substrate with a signal line propagating high frequency signals formed on one main surface side and a ground formed on the other main surface side, wherein one end portion of the signal line of the waveguide/planar line conversion substrate is located in such a manner as to protrude into the waveguide, and the waveguide/planar line conversion substrate is arranged on the whole top surface of the housing so as to cover the mouth of the waveguide.

Using the above waveguide/planar line converter according to the first aspect of the present invention, since the waveguide/planar line conversion substrate is arranged on the whole top surface of the housing so as to cover the mouth of the waveguide, the mounting of the waveguide/planar line conversion substrate onto the housing is easily conducted. Moreover, one end portion of the signal line can be accurately placed in a prescribed position above the mouth of the waveguide. As a result, the assembling with a high degree of mounting position accuracy can be easily achieved, leading to a simplified assembling operation.

A waveguide/planar line converter according to the second aspect of the present invention is characterized by a lid which is arranged in a position opposed to the waveguide with the waveguide/planar line conversion substrate between, and multiple first via holes for continuity between the housing and the lid which are formed in the waveguide/planar line conversion substrate in the above waveguide/planar line converter according to the first aspect of the present invention.

Using the above waveguide/planar line converter according to the second aspect of the present invention, these first via holes make it possible to prevent a high frequency signal passing through the waveguide/planar line conversion substrate from leaking to the waveguide/planar line conversion substrate portion outside the first via holes, resulting in a limited transmission characteristic degradation.

A waveguide/planar line converter according to the third aspect of the present invention is characterized by the main body of the lid, being made of an insulating member, in which second via holes to be connected to the first via holes, respectively, and a conductor layer connected to the top ends of the second via holes are formed in the above waveguide/planar line converter according to the second aspect of the present invention.

In the above waveguide/planar line converter according to the third aspect of the present invention, the main body of the lid is made of an insulating member. With the second via holes and the conductor layer formed therein, a high frequency signal propagating through the waveguide can be short-circuited, so that without losing the function of conducting efficient mode conversions, the light weight of the lid can be achieved.

A high frequency circuit arrangement according to the first aspect of the present invention is characterized by comprising a high frequency transmission substrate which has a signal line propagating high frequency signals formed on one main surface side, a ground directly connectable to a plane antenna formed on the other main surface side, and a wave-guiding channel for transmitting a high frequency signal between the signal line and the plane antenna.

Using the above high frequency circuit arrangement according to the first aspect of the present invention, since it is possible to directly connect the plane antenna with the high frequency transmission substrate, a conventionally used metallic housing with a waveguide formed therein is not required, resulting in a weight reduction of the device, a reduction in cost, and more, a downsizing thereof. In addition, since the component count can be reduced, the assembling processes can be reduced as well, resulting in a simplified assembling operation.

A high frequency circuit arrangement according to the second aspect of the present invention is characterized by the high frequency transmission substrate comprising an interconnection substrate in the above high frequency circuit arrangement according to the first aspect of the invention.

In the high frequency circuit arrangement according to the second aspect of the present invention, the high frequency transmission substrate comprises an interconnection substrate. Therefore, by making an interconnection substrate, which has been conventionally arranged in a separate area, integrated with the high frequency transmission substrate, the circuit area can be made smaller, leading to a downsizing of the device.

A high frequency circuit arrangement according to the third aspect of the present invention is characterized by the wave-guiding channel which is formed around one end portion of the signal line of the high frequency transmission substrate, being formed with multiple third via holes connected to the ground in the above high frequency circuit arrangement according to the first or second aspect of the present invention.

Using the above high frequency circuit arrangement according to the third aspect of the present invention, the wave-guiding channel formed with these third via holes makes it possible to prevent a high frequency signal passing through the high frequency transmission substrate from leaking to the high frequency transmission substrate portion outside these third via holes, resulting in a limited transmission characteristic degradation.

A high frequency circuit arrangement according to the fourth aspect of the present invention is characterized by the interconnection substrate in which a through hole with a conductor layer formed on the inner wall is formed in place of the third via holes in the above high frequency circuit arrangement according to the third aspect of the present invention.

In the above high frequency circuit arrangement according to the fourth aspect of the present invention, the through hole with the conductor layer formed thereinside functions as a wave-guiding channel in the interconnection substrate. Therefore, it is possible to reliably prevent leakage of a high frequency signal to the interconnection substrate portion, so that the effect of limiting a restraining transmission characteristic degradation can be enhanced.

A high frequency circuit arrangement according to the fifth aspect of the present invention is characterized by the ground which is shared with the plane antenna in any of the above high frequency circuit arrangements according to the first through fourth aspects of the present invention.

In the above high frequency circuit arrangement according to the fifth aspect of the present invention, the ground of the plane antenna in the connecting plane with the high frequency transmission substrate can be used as the ground of the high frequency transmission substrate, so that the ground of the high frequency transmission substrate need not be formed, resulting in a thinner and lighter device.

A high frequency circuit arrangement according to the sixth aspect of the present invention is characterized by the interconnection substrate which is arranged on both sides of the signal line with the signal line between, and conductor layers which are formed on the side walls of the interconnection substrate opposed to each other with the signal line between in any of the above high frequency circuit arrangements according to the second, third and fifth aspects of the present invention.

Using the above high frequency circuit arrangement according to the sixth aspect of the present invention, by the side walls of the interconnection substrate on which the conductor layers are formed, high frequency signals except those in the planar line mode can be cut off and be prevented from propagating, resulting in a reduced degradation of transmission characteristics. Moreover, since the interconnection substrate is arranged on both sides of the signal line with the signal line between, it is possible to reduce the circuit area, thereby enabling the device to be made smaller.

A high frequency circuit arrangement according to the seventh aspect of the present invention is characterized by a lid for short-circuiting the wave-guiding channel which is arranged over the wave-guiding channel of the high frequency transmission substrate in any of the above high frequency circuit arrangements according to the first through sixth aspects of the present invention.

Using the above high frequency circuit arrangement according to the seventh aspect of the present invention, the conversion between the waveguide mode wherein a high frequency signal propagates through the wave-guiding channel and the planar line mode wherein a high frequency signal propagates through the signal line of the high frequency transmission substrate can be efficiently conducted.

A high frequency circuit arrangement according to the eighth aspect of the present invention is characterized by the main body of the lid, being made of an insulating member, in which fourth via holes to be connected to the third via holes, respectively, and a conductor layer connected to the top ends of the fourth via holes are formed in the above high frequency circuit arrangement according to the seventh aspect of the present invention.

In the above high frequency circuit arrangement according to the eighth aspect of the present invention, the main body of the lid is made of an insulating member. With the fourth via holes and the conductor layer formed in the main body, a high frequency signal propagating through the wave-guiding channel can be short-circuited. Therefore, without losing the efficient mode converting function, the lid can be made lighter.

BRIEF DESCRIPTION OF THE DRAWINGS

FIGS. 11(*a*) and 11(*b*) are schematic diagrams showing a conventional waveguide/planar line conversion substrate, wherein FIG. 11(*a*) is a top view thereof, while FIG. 11(*b*) is a bottom view thereof.

DESCRIPTION OF THE PREFERRED EMBODIMENTS

Figure 1:
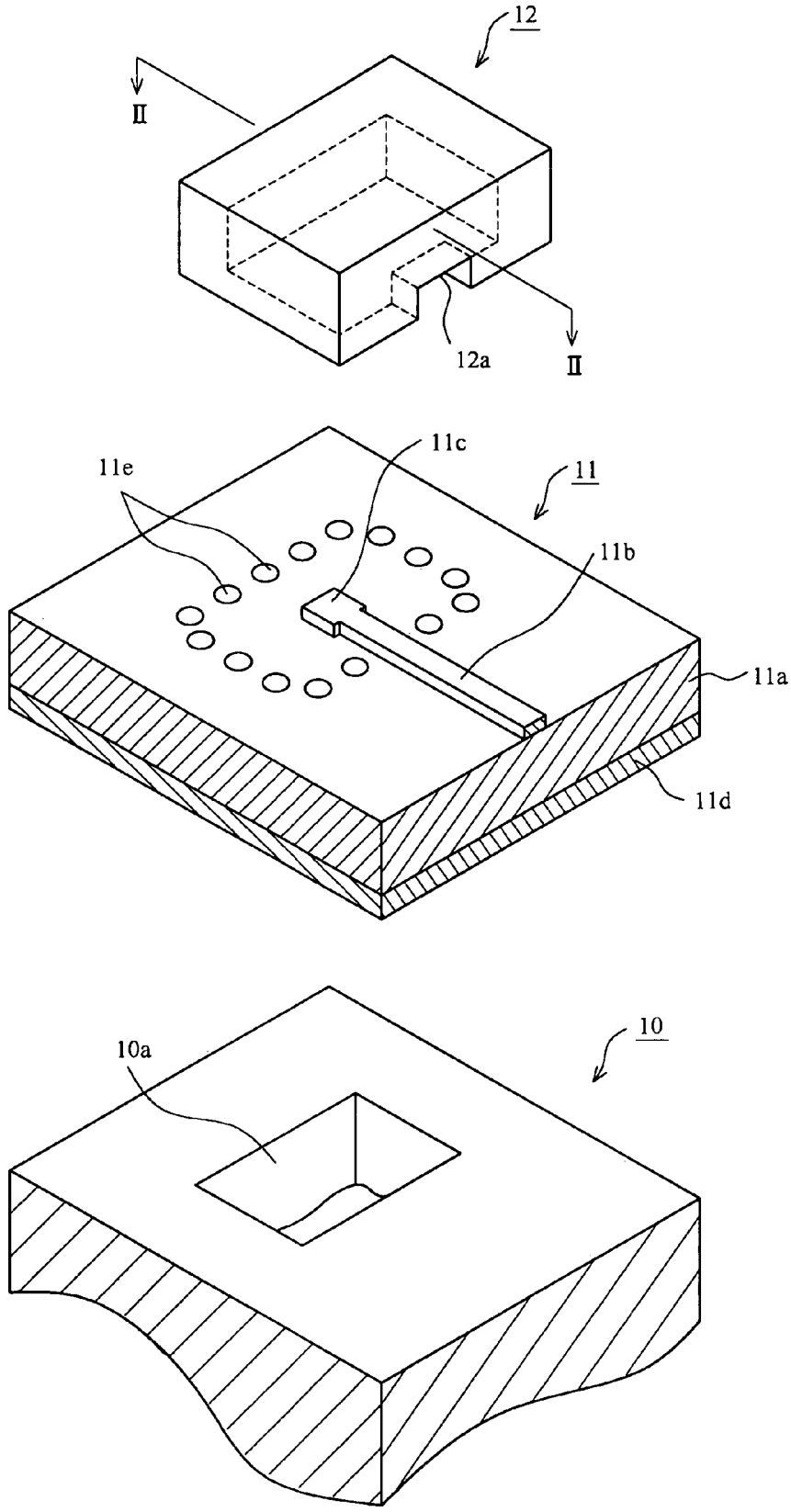
FIG. 1 is a partially exploded perspective view schematically showing the principal part of a waveguide/planar line converter according to a first embodiment of the present invention.
Figure 2:
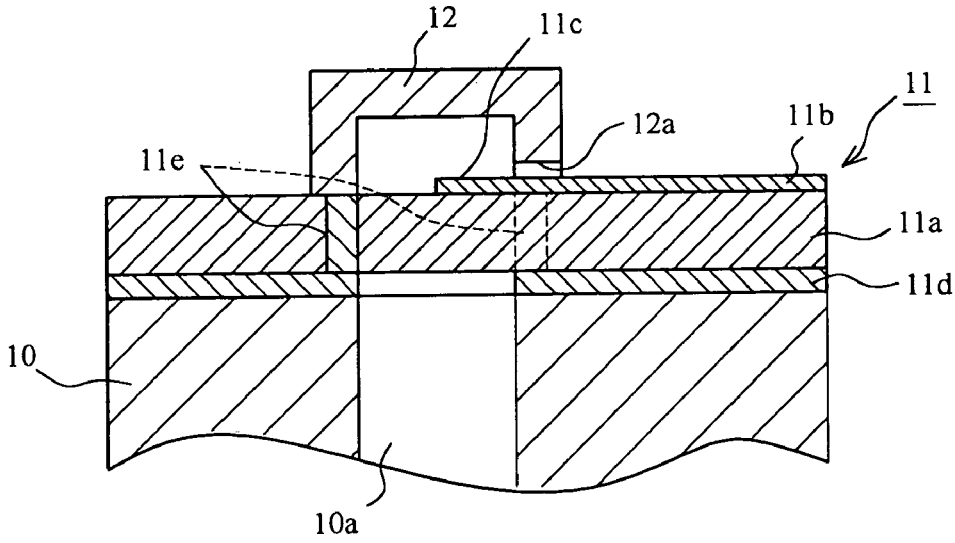
FIG. 2 is a fragmentary sectional view along line II—II of the waveguide/planar line converter shown in FIG. 1 in the assembled state.

The preferred embodiments of the waveguide/planar line converter and the high frequency circuit arrangement according to the present invention are described below by reference to the Figures noted above. FIG. 1 is a partially exploded perspective view schematically showing the principal part of a waveguide/planar line converter according to a first embodiment. FIG. 2 is a fragmentary sectional view along II—II line of the waveguide/planar line converter shown in FIG. 1 in the assembled state.

Reference numeral 10 in FIGS. 1 and 2 represents a metallic housing. At a prescribed location on the housing 10, a waveguide 10*a* comprising a through hole is formed. To the bottom of the housing 10, a plane antenna not shown is to be connected.

As shown in FIGS. 1 and 2, a waveguide/planar line conversion substrate 11 is arranged on the whole top surface of the housing 10 such that it covers the mouth of the waveguide 10*a*. On the top surface of a dielectric substrate 11*a* constituting the waveguide/planar line converter 11, a signal line 11*b* which propagates high frequency signals is formed. In one end portion of the signal line 11*b*, a rectangular patch portion 11*c* suitable for emitting a high frequency signal into the air is formed so as to be located in a prescribed position above the mouth of the waveguide 10*a*. The other end portion of the signal line 11*b* is to be connected to a high frequency IC not shown. On the bottom surface of the dielectric substrate 11*a* except the opening portion of the waveguide 10*a*, a ground 11*d* is formed.

The waveguide/planar line conversion substrate 11 comprises the dielectric substrate 11*a*, signal line 11*b*, patch portion 11*c*, and ground 11*d*. As a material for forming the dielectric substrate 11*a*, a ceramic such as alumina or aluminum nitride, Teflon, and similar materials having excellent high frequency characteristics, can be utilized.

In the dielectric substrate 11*a*, multiple via holes 11*e* for continuity between the housing 10 and a metallic short-circuiting lid 12 are formed. The via holes 11*e* are preferably formed in such a manner so as to be inscribed in the same plane as the inner wall surface of the waveguide 10*a*, and are formed at established intervals in such a manner so as to surround the waveguide 10*a*. The established interval need only be equal to or shorter than the wavelength of a high frequency signal passing through the dielectric substrate 11*a* which can be prevented from leaking through the spaces between the via holes 11*e* to the dielectric substrate 11*a* portion. It is more favorable to make the interval as small as possible, but it is necessarily limited by the technique of forming the via holes 11*e* closer to each other in the dielectric substrate 11*a*.

On the top surface of the waveguide/planar line conversion substrate 11, the metallic short-circuiting lid 12 for short-circuiting the waveguide 10*a* is arranged. The bottom portion of the short-circuiting lid 12 is to be connected to the top ends of the via holes 11*e*. On one side of the short-circuiting lid 12, a notch 12*a* is formed in order to avoid causing a short circuit in the signal line 11*b*. Since the conversion efficiency is enhanced by arranging the patch portion 11*c* in a position with a strong electric field within the waveguide 10*a*, the distance between the short-circuiting plane (inner surface) of the short-circuiting lid 12 and the patch portion 11*c* is set to be $\lambda/4$ (where $\lambda$ is the wavelength of a high frequency).

In the waveguide/planar line converter with the above construction, a high frequency signal received by the plane antenna propagates through the waveguide 10*a* and the wave-guiding channel formed with the via holes 11*e* of the dielectric substrate 11*a* in the waveguide mode, and reaches the inner surface of the short-circuiting lid 12 to make a short circuit. Consequently, the electric field of the high frequency peaks in the vicinity of the patch portion 11*c*, so that the waveguide mode is efficiently converted to the planar line mode of a microstrip line in the waveguide/planar line conversion substrate 11. This high frequency signal in the planar line mode propagates through the signal line 11*b* to be transmitted to a high frequency IC (not shown).

On the other hand, a high frequency signal output from the high frequency IC propagates through the signal line 11*b* of the waveguide/planar line conversion substrate 11 in the planar line mode, is converted from the planar line mode to the waveguide mode in the patch portion 11*c* and is emitted into the wave-guiding channel formed with the via holes 11*e* and the waveguide 10*a* so as to be transmitted to the plane antenna.

In the above waveguide/planar line converter according to the first embodiment, the waveguide/planar line conversion substrate 11 is arranged on the whole top surface of the housing 10 so as to cover the mouth of the waveguide 10*a*. Therefore, it becomes easy to mount the waveguide/planar line conversion substrate 11 onto the housing 10, and moreover, it is possible to accurately place the patch portion 11*c* of the signal line 11*b* in a prescribed position above the mouth of the waveguide 10*a*. As a result, assembling with a high degree of mounting position accuracy can be easily realized, resulting in a simplified assembling operation.

In addition, the multiple via holes 11*e* make it possible to prevent a high frequency signal passing through the waveguide/planar line conversion substrate 11 from leaking to the waveguide/planar line conversion substrate 11 portion outside the via holes 11*e*, resulting in a limited transmission characteristic degradation.

Figure 3:
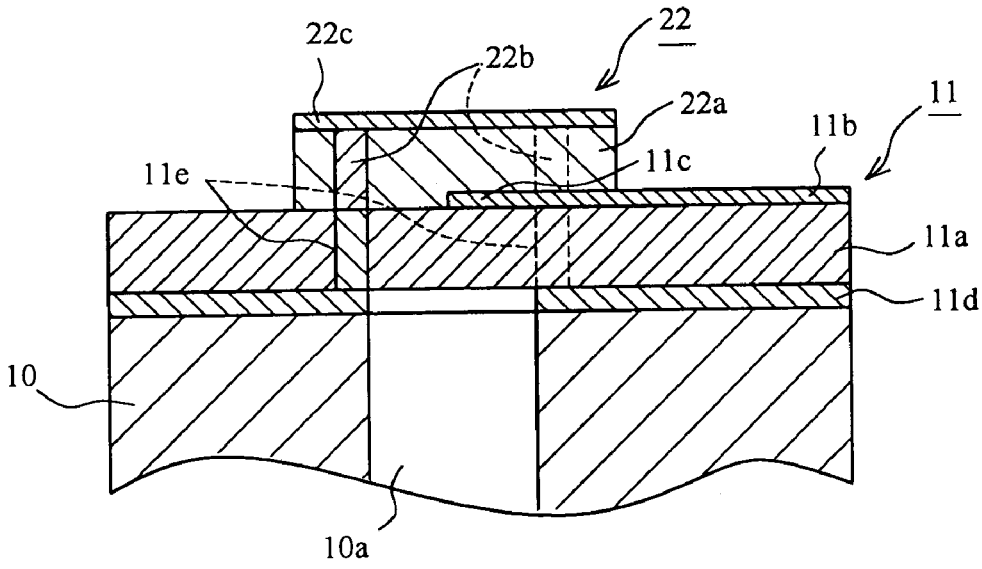
FIG. 3 is a fragmentary sectional view schematically showing the principal part of a waveguide/planar line converter according to a second embodiment.

FIG. 3 is a fragmentary sectional view schematically showing the principal part of a waveguide/planar line converter according to a second embodiment. Here, the section is obtained at the same position as that of the waveguide/planar line converter according to the first embodiment shown in FIG. 2. Components having the same functions as those of the waveguide/planar line converter according to the first embodiment are similarly marked, and are not described below.

The difference of the waveguide/planar line converter according to the second embodiment from the waveguide/planar line converter according to the first embodiment is the structure of a short-circuiting lid 22. In the first embodiment, the short-circuiting lid 12 is metallic, while in the second embodiment, the main body 22*a* of the short-circuiting lid 22 comprises an insulating member.

On the top surface of a waveguide/planar line conversion substrate 11, the short-circuiting lid 22 for short-circuiting a waveguide 10*a* is arranged. The main body 22*a* of the short-circuiting lid 22 is made of an insulating material, for example, a ceramic such as alumina or aluminum nitride, or Teflon, similarly to a dielectric substrate 11*a* of the waveguide/planar line conversion substrate 11. At prescribed places of the main body 22*a*, via holes 22*b* to be connected to via holes 11*e* of the waveguide/planar line conversion substrate 11, respectively, are formed, and on the top surface of the main body 22*a*, a conductor layer 22*c* connected to the top ends of these via holes 22*b* is formed.

In the waveguide/planar line converter according to the second embodiment, the main body 22*a* of the short-circuiting lid 22 is made of an insulating material. Therefore, the via holes 22*b* formed in the main body 22*a* and the conductor layer 22*c* enable sealing of a high frequency signal transmitted through the waveguide 10*a*, so that a light weight can be achieved without losing an efficient conversion function.

Figure 4:
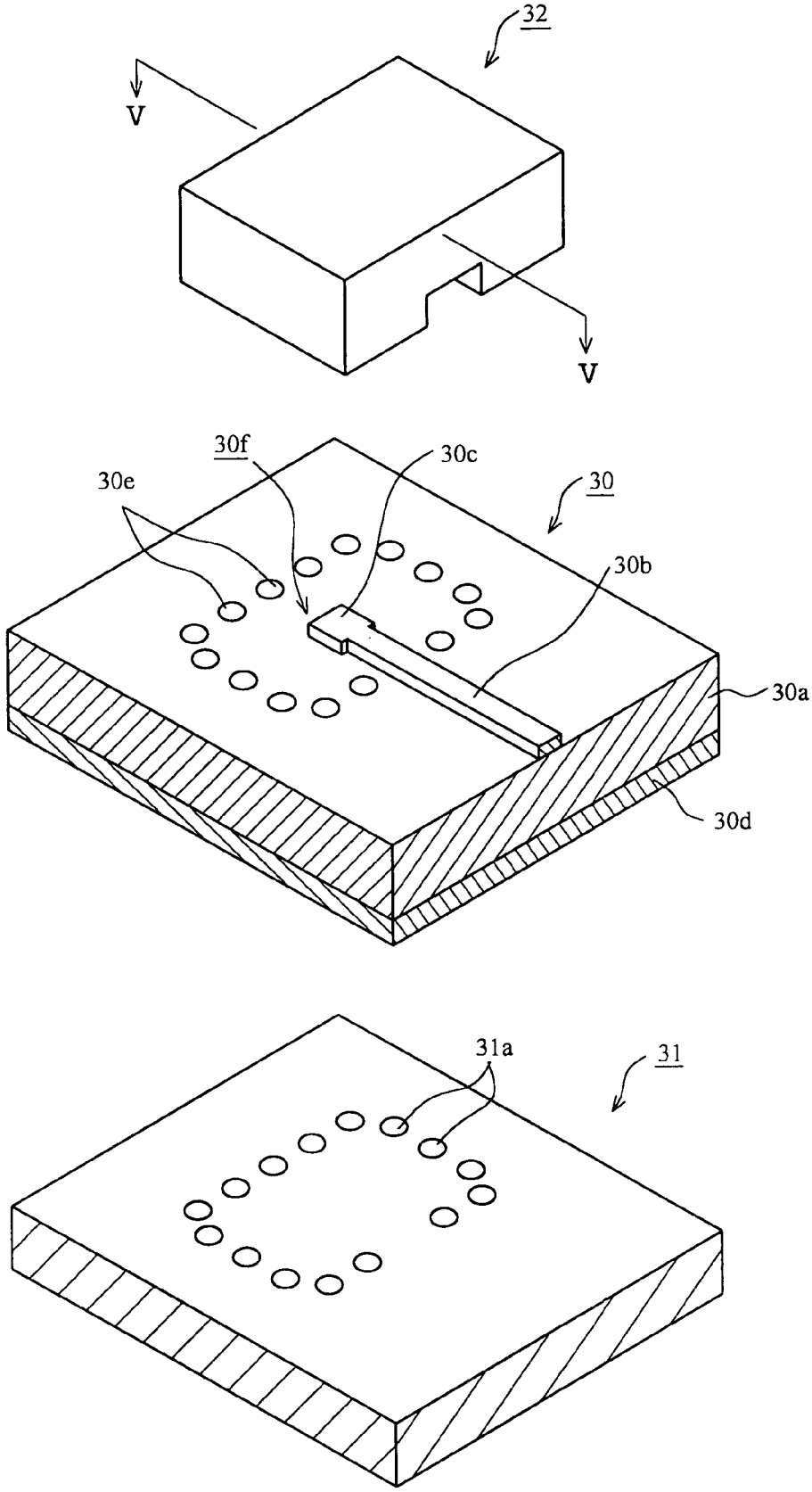
FIG. 4 is a partially exploded perspective view schematically showing the principal part of a high frequency circuit arrangement according to a third embodiment.
Figure 5:
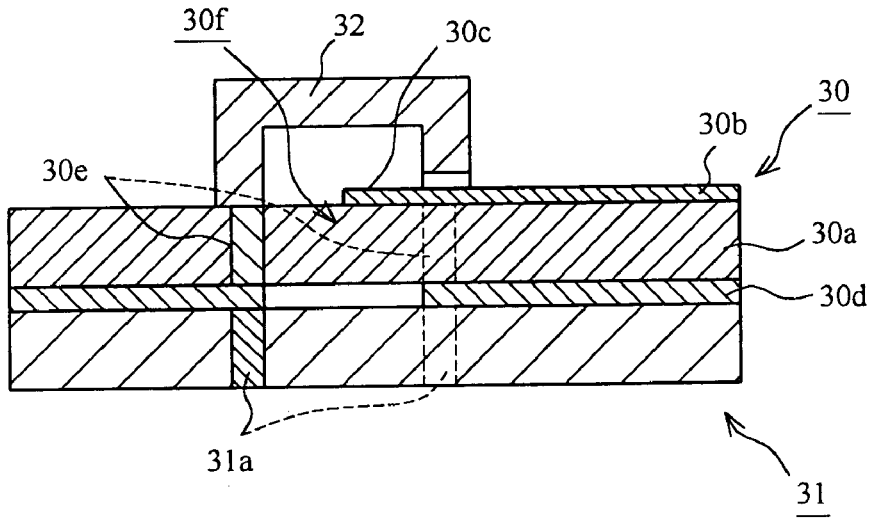
FIG. 5 is a fragmentary sectional view along V—V line of the high frequency circuit arrangement shown in FIG. 4 in the assembled state.

FIG. 4 is a partially exploded perspective view schematically showing the principal part of a high frequency circuit arrangement according to a third embodiment. FIG. 5 is a fragmentary sectional view along V—V line of the high frequency circuit arrangement according to the third embodiment shown in FIG. 4 in the assembled state. Here, components having the same functions as those of the waveguide/planar line converter shown in FIG. 1 are similarly marked, and are not described below.

In the waveguide/planar line converter according to the first embodiment shown in FIG. 1, the waveguide/planar line conversion substrate 11 and the plane antenna (not shown) are to be connected through the housing 10. On the other hand, in the high frequency circuit arrangement according to the third embodiment, a high frequency transmission substrate 30 is to be directly connected to a plane antenna 31, differently from the waveguide/planar line converter according to the first embodiment.

On the top surface of a dielectric substrate 30*a* constituting the high frequency transmission substrate 30, a signal line 30*b* is formed. In one end portion of the signal line 30*b*, a rectangular patch portion 30*c* suitable for emitting a high frequency signal into space is formed, which is formed in such a manner so as to be located in a prescribed place above the mouth of the waveguide 10*a* (see FIG. 1). The other end portion of the signal line 30*b* is to be connected to a high frequency IC not shown. On the bottom surface of the dielectric substrate 30*a*, a ground 30*d* is formed.

The high frequency transmission substrate 30 comprises the dielectric substrate 30*a*, signal line 30*b*, patch portion 30*c* and ground 30*d*. As a material for forming the dielectric substrate 30*a*, a ceramic such as alumina or aluminum nitride, Teflon, and similar materials having excellent high frequency characteristics, can be utilized.

Around the patch portion 30*c*, multiple via holes 30*e* are formed at established intervals, and these multiple via holes 30*e* form a wave-guiding channel 30*f* which seals a high frequency. The bottom ends of the via holes 30*e* are connected to the ground 30*d*, but in the wave-guiding channel 30*f* area, the ground 30*d* is not formed.

The area of the wave-guiding channel 30*f* may be set as necessary in accordance with the characteristics of a transmitted high frequency signal. The established interval need only be equal to or shorter than the wavelength of a high frequency signal which can be prevented from leaking through the spaces between the via holes 30*e* to the dielectric substrate 30*a* portion. It is more favorable to make the interval as small as possible, but it is necessarily limited by the technique of forming the via holes 30*e* closer to each other in the dielectric substrate 30*a*.

To the bottom surface of the high frequency transmission substrate 30, a plane antenna 31 in almost the same form as the high frequency transmission substrate 30 is directly connected. As the plane antenna 31, plane antennas of various types can be adopted. In this embodiment, for example, the plane antenna 31 of a triplate structure can be adopted, wherein a grounding conductor plate is formed on the plane facing the ground 30*d* of the high frequency transmission substrate 30 except the wave-guiding channel 30*f* area therein, and on the bottom of the grounding conductor plate, a dielectric substrate, an antenna substrate, a dielectric substrate, and an emitting aperture conductor plate (none of them shown) are laminated in the order thereof.

On the antenna substrate, multiple rectangular patch portions for emitting or receiving radio waves are arranged in consideration of the wavelength of the radio waves and the like. These patch portions are connected under constant rules in consideration of the line width which enables the radio waves to be kept inside the dielectric substrate and the like so as to form an antenna pattern, in such a manner that the termination of the antenna pattern is located in the position opposed to the patch portion 30*c* of the high frequency transmission substrate 30 within the wave-guiding channel 30*f*. Around the termination of the antenna pattern, multiple via holes 31*a* to be connected to the multiple via holes 30*e* forming the wave-guiding channel 30*f*, respectively, are formed at established intervals.

On the emitting aperture conductor plate, rectangular emitting apertures are formed in the positions facing the patch portions on the antenna substrate, respectively. Through the emitting apertures, the emission of radio waves to the outside, or the reception of incoming radio waves is conducted.

Using such a plane antenna 31, a high frequency signal is propagated in such a manner that radio waves are kept inside the dielectric substrate with the grounding conductor plate and the emitting aperture conductor plate which sandwich the dielectric substrates sandwiching the antenna substrate.

On the top surface of the high frequency transmission substrate 30, a metallic short-circuiting lid 32 for sealing the wave-guiding channel 30*f* is arranged, and the bottom of the short-circuiting lid 32 is connected to the top ends of the via holes 30*e*.

In the high frequency circuit arrangement having the above construction, a high frequency signal received by the plane antenna 31 propagates through the wave-guiding channel 30*f* formed with the via holes 30*e* of the high frequency transmission substrate 30 in the waveguide mode, and reaches the inner surface of the short-circuiting lid 32 to make a short circuit. Consequently, the electric field of the high frequency peaks in the vicinity of the patch portion 30*c*, so that in the high frequency transmission substrate 30, the waveguide mode is efficiently converted to the planar line mode of a microstrip line. This high frequency signal converted into the planar line mode propagates through the signal line 30*b* to be transmitted to a high frequency IC (not shown).

A high frequency signal output from the high frequency IC propagates through the signal line 30*b* of the high frequency transmission substrate 30 in the planar line mode and in the patch portion 30*c*, is converted from the planar line mode to the waveguide mode and is emitted. Then, it propagates through the wave-guiding channel 30*f* formed with the via holes 30*e* of the high frequency transmission substrate 30 to be transmitted to the plane antenna 31 and to be emitted to the outside.

In the above high frequency circuit arrangement according to the third embodiment, the plane antenna 31 and the high frequency transmission substrate 30 can be directly connected. Therefore, a metallic housing conventionally used as a platform on which those are mounted is not required, resulting in a weight reduction of the device, a cost reduction, and more, a downsizing thereof. In addition, the component count can be reduced, so that less assembling steps are needed, leading to simplified assembling works.

The wave-guiding channel 30*f* formed with the multiple via holes 30*e* makes it possible to prevent a high frequency signal passing through the high frequency transmission substrate 30 from leaking to the high frequency transmission substrate 30 portion outside these via holes 30*e*, resulting in a limited transmission characteristic degradation.

Over the top of the wave-guiding channel 30*f* of the high frequency transmission substrate 30, the short-circuiting lid 32 for short-circuiting the wave-guiding channel 30*f*, being connected to the top ends of the via holes 30*e*, is arranged, so that the conversion between the waveguide mode wherein a high frequency signal propagates through the wave-guiding channel 30*f* and the planar line mode wherein a high frequency signal propagates through the high frequency transmission substrate 30 can be efficiently conducted.

Here, in the above high frequency circuit arrangement according to the third embodiment, the ground 30*d* is formed on the high frequency transmission substrate 30, but in another embodiment, without forming the ground 30*d* on the high frequency transmission substrate 30, the grounding conductor plate (not shown) of the plane antenna 31 may be used as a shared ground. In such construction, the grounding conductor plate of the plane antenna 31 in the connecting plane with the high frequency transmission substrate 30 can be used as a ground of the high frequency transmission substrate 30, so that the ground 30*d* of the high frequency transmission substrate 30 need not be formed, leading to a still thinner and lighter device.

Figure 6:
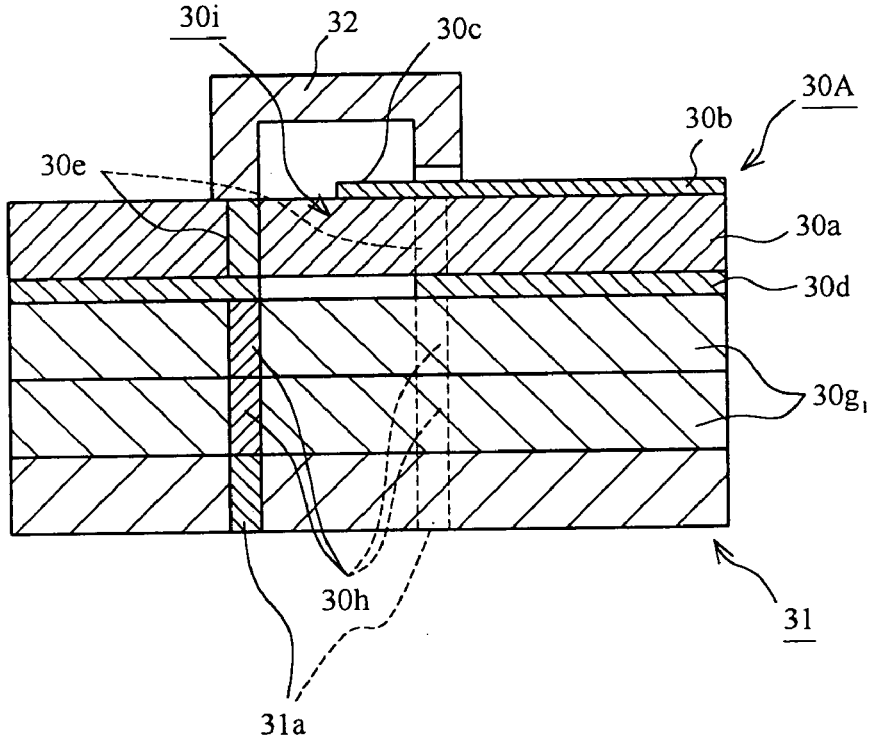
FIG. 6 is a fragmentary sectional view schematically showing the principal part of a high frequency circuit arrangement according to a fourth embodiment.

FIG. 6 is a fragmentary sectional view schematically showing the principal part of a high frequency circuit arrangement according to a fourth embodiment. Here, the section is obtained at the same position as that of the high frequency circuit arrangement according to the third embodiment shown in FIG. 5, and components having the same functions as those of the high frequency circuit arrangement shown in FIG. 5 are similarly marked, and are not described below.

The difference of the high frequency circuit arrangement according to the fourth embodiment from the high frequency circuit arrangement according to the third embodiment shown in FIGS. 4 and 5 is the structure of a high frequency transmission substrate 30A. In the third embodiment, the main body of the high frequency transmission substrate 30 comprises the dielectric substrate 30*a*, while in the fourth embodiment, the main body of the high frequency transmission substrate 30A comprises a dielectric substrate 30*a* and an interconnection substrate $\mathbf{30}g_1$.

On the top surface of the dielectric substrate 30*a* constituting the high frequency transmission substrate 30A, a signal line 30*b* and a patch portion 30*c* are formed, while on the bottom surface thereof, a ground 30*d* is formed.

Around the patch portion 30*c* on the dielectric substrate 30*a*, multiple via holes 30*e* are formed at established intervals, and to the bottom ends of the via holes 30*e*, the ground 30*d* is connected.

On the bottom surface of the dielectric substrate 30*a*, the interconnection substrate $\mathbf{30}g_1$ of a multilayer structure is arranged with the ground 30*d* therebetween. As a material for forming the interconnection substrate 30$g_1$, materials having excellent high frequency characteristics such as ceramics of various kinds and Teflon can be utilized. In the interconnection substrate 30$g_1$, interconnections (not shown) to be connected to a high frequency IC (not shown) mounted on the dielectric substrate 30*a*, and the like are formed.

In the interconnection substrate 30$g_1$, via holes 30*h* to be connected to the multiple via holes 30*e* formed in the dielectric substrate 30*a*, respectively, are formed. The via holes 30*e* and 30*h* form a wave-guiding channel 30*i* which seals a high frequency signal. To the bottom of the interconnection substrate 30$g_1$, a plane antenna 31 is directly connected.

The high frequency transmission substrate 30A comprises the dielectric substrate 30*a*, signal line 30*b*, patch portion 30*c*, ground 30*d* and interconnection substrate 30$g_1$.

In the high frequency circuit arrangement having the above construction, a high frequency signal received by the plane antenna 31 propagates through the wave-guiding channel 30*i* formed with the via holes 30*h* and 30*e* of the high frequency transmission substrate 30A in the waveguide mode, and reaches the inner surface of a short-circuiting lid 32 to make a short circuit. Consequently, the electric field of the high frequency peaks in the vicinity of the patch portion 30*c*, so that in the high frequency transmission substrate 30A, the waveguide mode is efficiently converted to the planar line mode of a microstrip line. This high frequency signal in the planar line mode propagates through the signal line 30*b* to be transmitted to a high frequency IC (not shown).

A high frequency signal output from the high frequency IC propagates through the signal line 30*b* of the high frequency transmission substrate 30A in the planar line mode. It is converted from the planar line mode to the waveguide mode in the patch portion 30*c* and is emitted. Then, it propagates through the wave-guiding channel 30*i* formed with the via holes 30*e* and 30*h* of the high frequency transmission substrate 30A to be transmitted to the plane antenna 31 and to be emitted externally.

In the above high frequency circuit arrangement according to the fourth embodiment, the interconnection substrate 30$g_1$ conventionally arranged in a separate area and the dielectric substrate 30*a* can be made multilayered to be united as the high frequency transmission substrate 30A, leading to a smaller circuit area and a downsizing of the device.

Figure 7:
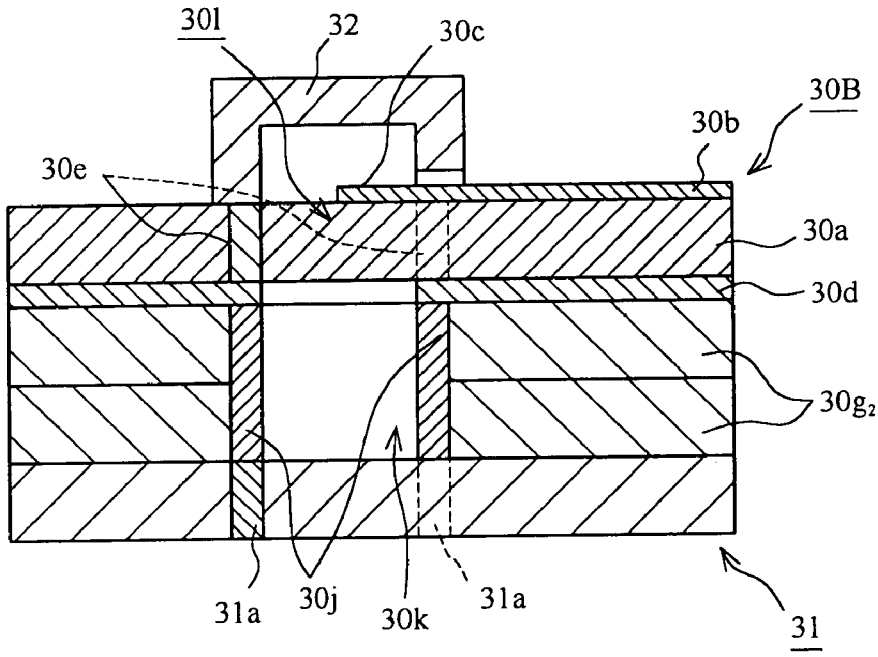
FIG. 7 is a fragmentary sectional view schematically showing the principal part of a high frequency circuit arrangement according to a fifth embodiment.

FIG. 7 is a fragmentary sectional view schematically showing the principal part of a high frequency circuit arrangement according to a fifth embodiment. Here, the section is obtained at the same position as that of the high frequency circuit arrangement according to the third embodiment shown in FIG. 5, and components having the same functions as those of the high frequency circuit arrangement shown in FIG. 5 are similarly marked, and are not described below.

The difference of the high frequency circuit arrangement according to the fifth embodiment from the high frequency circuit arrangement according to the fourth embodiment shown in FIG. 6 is the structure of a high frequency transmission substrate 30B. In the fourth embodiment, the via holes 30*h* are formed in the interconnection substrate 30$g_1$ constituting the high frequency transmission substrate 30A, with which the wave-guiding channel 30*i* is formed, while in the fifth embodiment, a through hole 30*k* with a conductor layer 30*j* formed on its inner surface is formed in an interconnection substrate 30$g_2$ in place of the via holes 30*h*, from which a wave-guiding channel 301 is formed.

On the top surface of a dielectric substrate 30*a* constituting the high frequency transmission substrate 30B, a signal line 30*b* and a patch portion 30*c* are formed, while on the bottom surface thereof, a ground 30*d* is formed. The high frequency transmission substrate 30B comprises the dielectric substrate 30*a*, signal line 30*b*, patch portion 30*c*, ground 30*d* and interconnection substrate 30$g_2$.

Around the patch portion 30*c* on the dielectric substrate 30*a*, multiple via holes 30*e* are formed at established intervals, and to the bottom ends of the via holes 30*e*, the ground 30*d* is connected.

On the bottom surface of the dielectric substrate 30*a*, the interconnection substrate 30$g_2$ is arranged with the ground 30*d* therebetween. In the interconnection substrate 30$g_2$, the through hole 30*k* is formed, besides interconnections (not shown) to be connected to a high frequency IC (not shown) mounted on the dielectric substrate 30*a* and the like. On the inner wall of the through hole 30*k*, the conductor layer 30*j* (e.g. a metal plating layer) is formed. The conductor layer 30*j* is to be connected to the multiple via holes 30*e* formed in the dielectric substrate 30*a*. The via holes 30*e* and the through hole 30*k* with the conductor layer 30*j* formed thereinside constitute the wave-guiding channel 301 which seals a high frequency signal.

To the bottom surface of the interconnection substrate 30$g_2$ constituting the high frequency transmission substrate 30B, a plane antenna 31 is directly connected.

In the high frequency circuit arrangement having the above construction, a high frequency signal received by the plane antenna 31 propagates through the wave-guiding channel 301 formed with the conductor layer 30*j* and the via holes 30*e* of the high frequency transmission substrate 30B in the waveguide mode, and reaches the inner surface of a short-circuiting lid 32 to make a short circuit. Consequently, the electric field of the high frequency peaks in the vicinity of the patch portion 30*c*, so that in the high frequency transmission substrate 30B, the waveguide mode is efficiently converted to the planar line mode of a microstrip line. This high frequency signal in the planar line mode propagates through the signal line 30*b* to be transmitted to the high frequency IC (not shown).

A high frequency signal output from the high frequency IC propagates through the signal line 30*b* of the high frequency transmission substrate 30B in the planar line mode. It is converted from the planar line mode to the waveguide mode in the patch portion 30*c* and is emitted. Then, it propagates through the wave-guiding channel 301 formed with the via holes 30*e* and the conductor layer 30*j* of the high frequency transmission substrate 30B to be transmitted to the plane antenna 31 and to be emitted to the outside.

In the above high frequency circuit arrangement according to the fifth embodiment, the through hole 30*k* with the conductor layer 30*j* formed thereinside functions as the wave-guiding channel 301 in the interconnection substrate 30$g_2$. Therefore, it is possible to reliably prevent leakage of the high frequency signal to the interconnection substrate 30$g_2$ portion, resulting in an enhanced effect of limiting the degradation of transmission characteristics.

Figure 8:
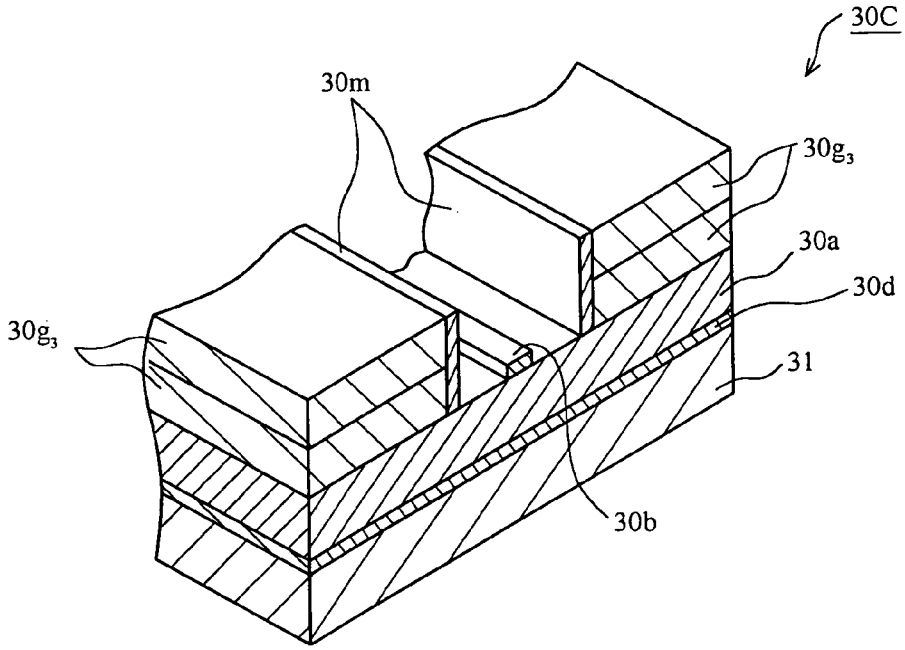
FIG. 8 is a fragmentary sectional perspective view schematically showing the principal part of a high frequency circuit arrangement according to a sixth embodiment.

FIG. 8 is a fragmentary sectional perspective view schematically showing the principal part of a high frequency circuit arrangement according to a sixth embodiment. It shows a section obtained by cutting the arrangement vertically to the longitudinal direction of a signal line 30*b* formed on a dielectric substrate 30*a* of a high frequency transmission substrate 30C.

The construction of the high frequency circuit arrangement according to the sixth embodiment is the same as that of the high frequency circuit arrangement according to the third embodiment shown in FIGS. 4 and 5 except the high frequency transmission substrate 30C, so that the high frequency transmission substrate 30C having a different function is differently marked, while other components having the same functions are similarly marked, and are not described below.

On the top surface of the dielectric substrate 30*a* constituting the high frequency transmission substrate 30C, a signal line 30*b* and a patch portion (not shown) are formed. A multilayered interconnection substrate $\mathbf{30}g_3$ is arranged on both sides of the signal line 30*b* with the signal line 30*b* between except in the location area of a short-circuiting lid (not shown), and conductor layers 30*m* (e.g. metal plating layers) are formed on the side wall surfaces of the interconnection substrate $\mathbf{30}g_3$ opposed to each other with the signal line 30*b* between.

To the bottom surface of the dielectric substrate 30*a*, a plane antenna 31 is directly connected through a ground 30*d*.

Using the above high frequency circuit arrangement according to the sixth embodiment, by the side walls of the interconnection substrate $\mathbf{30}g_3$ with the conductor layers 30*m* formed thereon, high frequency signals except those in the planar line mode are cut off and are prevented from propagating, resulting in a reduced degradation of transmission characteristics. Since the interconnection substrate $\mathbf{30}g_3$ is arranged on both sides of the signal line 30*b* with the signal line 30*b* on the dielectric substrate 30*a* between, the circuit area can be made smaller, thereby enabling the device to be made smaller.

Here, as to the above high frequency circuit arrangement according to the sixth embodiment, a case where the interconnection substrate $\mathbf{30}g_3$ is arranged on the top of the dielectric substrate 30*a* of the high frequency transmission substrate 30 constituting the high frequency circuit arrangement according to the third embodiment shown in FIGS. 4 and 5 is described, but in another embodiment, the interconnection substrate $\mathbf{30}g_3$ may be arranged on the top of the dielectric substrate 30*a* of the high frequency transmission substrate 30A or 30B constituting the high frequency circuit arrangement according to the fourth or fifth embodiment shown in FIG. 6 or 7, respectively, resulting in an arrangement of interconnection substrates on the top and bottom of the dielectric substrate 30*a*.

As to the above high frequency circuit arrangements according to the third through sixth embodiments, cases are described where as the short-circuiting lid 32 arranged on the top of the high frequency transmission substrate, a metallic lid is used. In place of the metallic short-circuiting lid 32, the short-circuiting lid 22 with its main body made of an insulating material described in the waveguide/planar line conversion substrate according to the second embodiment may be adopted.

Figure 9:
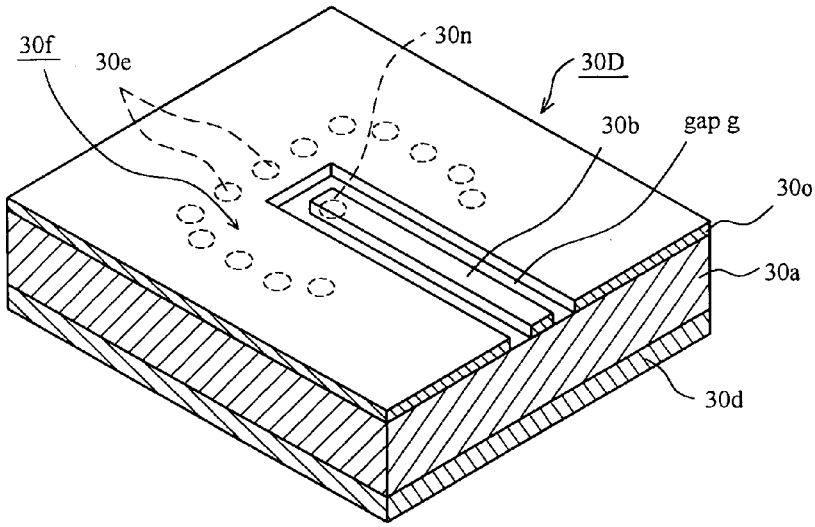
FIGS. 9(*a*) and 9(*b*) are schematic diagrams showing a high frequency transmission substrate of a high frequency circuit arrangement according to a seventh embodiment, wherein FIG. 9(*a*) is a top fragmentary sectional perspective view, while FIG. 9(*b*) is a bottom fragmentary sectional perspective view.
Figure 9:
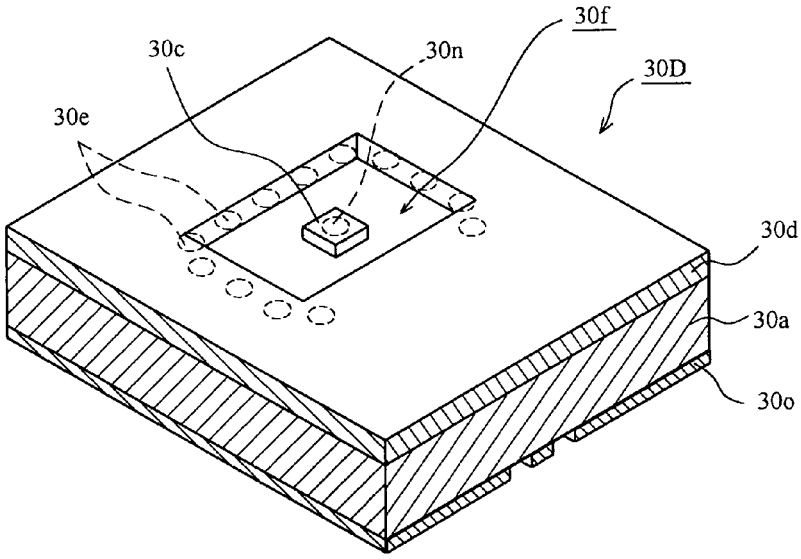
Figure 10:
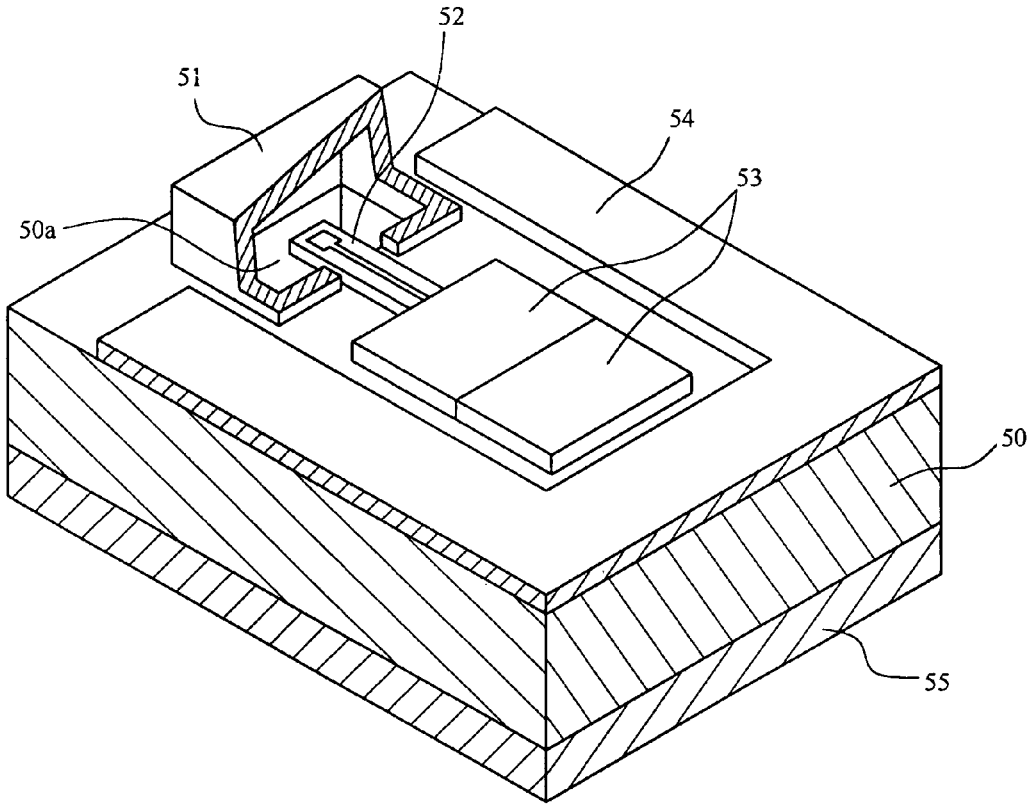
Fig.10 PRIOR ART
FIG. 10 is a partly sectional perspective view schematically showing the principal part of a conventional waveguide/planar line converter.
Figure 10:
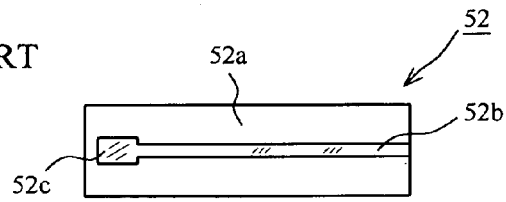
Fig.10 PRIOR ART
Figure 10:
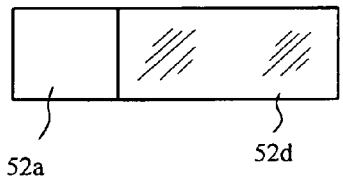
Fig.10 PRIOR ART

FIGS. 9(*a*) and 9(*b*) are schematic diagrams showing a high frequency transmission substrate constituting a high frequency circuit arrangement according to a seventh embodiment, wherein FIG. 9(*a*) is a top fragmentary sectional perspective view, while FIG. 9(*b*) is a bottom fragmentary sectional perspective view.

The construction of the high frequency circuit arrangement according to the seventh embodiment is about the same as the high frequency circuit arrangement according to the third embodiment shown in FIGS. 4 and 5 except no short-circuiting lid 32 is required and a high frequency transmission substrate 30D is provided. Therefore, the high frequency transmission substrate 30D having a different function is differently marked, while other components having the same functions are similarly marked, and are not described below.

As shown in FIGS. 9(*a*) and 9(*b*), on the top surface of a dielectric substrate 30*a* constituting the high frequency transmission substrate 30D, a signal line 30*b* is formed, and one end portion of the signal line 30*b* is connected to a patch portion 30*c* formed on the bottom surface of the dielectric substrate 30*a* through a via hole 30*n* formed in the dielectric substrate 30*a*. Moreover, around the signal line 30*b* on the top of the dielectric substrate 30*a*, a ground 30*o* is formed with a gap g interposed. The ground 30*o* is connected to a ground 30*d* formed on the bottom surface of the dielectric substrate 30*a* through via holes 30*e* formed at established intervals around the one end portion of the signal line 30*b*.

The high frequency transmission substrate 30D comprises the dielectric substrate 30*a*, signal line 30*b*, ground 30*o*, patch portion 30*c* and ground 30*d*.

In the above high frequency circuit arrangement according to the seventh embodiment, the via holes 30*e* and the ground 30*o* formed in and on the high frequency transmission substrate 30D to enable sealing of a high frequency signal transmitted through a wave-guiding channel 30*f*, so that a high frequency circuit arrangement without any need for a short-circuiting lid 32 can be constructed, resulting in a thinner device.

What is claimed is:

1. A high frequency circuit arrangement comprising:

a high frequency transmission substrate, wherein the high frequency transmission substrate comprises:

a signal line propagating high frequency signals disposed on a first main surface side;

a ground directly connectable to a plane antenna disposed on a second main surface side;

a wave-guiding channel for transmitting a high frequency signal between the signal line and the plane antenna;

wherein a lid for short-circuiting the wave-guiding channel is arranged over the wave-guiding channel of the high frequency transmission substrate; and wherein a main body of the lid is comprised of an insulating member, in which second via holes are arranged so as to be connected to first via holes, respectively, and a conductor layer is arranged so as to be connected to top ends of the second via holes.

2. A high frequency circuit arrangement comprising:

a high frequency transmission substrate, wherein the high frequency transmission substrate comprises:

a signal line propagating high frequency signals disposed on a first main surface side;

a ground connectable to a plane antenna and disposed on a second main surface side;

a wave-guiding channel for transmitting a high frequency signal between the signal line and the plane antenna; and an interconnection substrate disposed between the ground and the plane antenna;

wherein the wave-guiding channel is disposed around one end portion of the signal line of the high frequency substrate; and wherein a through hole with a conductor layer disposed on an inner wall thereof is disposed in the interconnection substrate.

3. A waveguide/planar line converter, comprising:

a housing having a waveguide; and a waveguide/planar line conversion substrate with a signal line propagating high frequency signals disposed on a first main surface side and a ground formed on a second main surface side;

wherein one end portion of the signal line disposed on the waveguide/planar line conversion substrate is located in such a manner so as to protrude into the waveguide;

wherein the waveguide/planar line conversion substrate is arranged on a whole top surface of the housing so as to cover a mouth of the waveguide;

wherein a lid is arranged in a position opposed to the waveguide with the waveguide/planar line conversion substrate disposed therebetween;

wherein multiple first via holes for continuity between the housing and the lid are disposed in the waveguide/planar line conversion substrate; and wherein a main body of the lid is comprised of an insulating member, in which second via holes are arranged so as to be connected to the first via holes, respectively, and a conductor layer is arranged so as to be connected to top ends of the second via holes.

4. A high frequency circuit arrangement comprising:

a high frequency transmission substrate, wherein the high frequency transmission substrate comprises:

a signal line propagating high frequency signals disposed on a first main surface side;

a ground directly connectable to a plane antenna and disposed on a second main surface side;

a wave-guiding channel for transmitting a high frequency signal between the signal line and the plane antenna;

wherein the ground is shared with the plane antenna;

wherein an interconnection substrate is arranged on both sides of the signal line with the signal line disposed therebetween, and wherein conductor layers are disposed on side walls of the interconnection substrate and are opposed to each other with the signal line disposed therebetween.

* * * * *